US007357199B2

(12) United States Patent
Pedrelli

(10) Patent No.: US 7,357,199 B2
(45) Date of Patent: Apr. 15, 2008

(54) BIT FOR EXCAVATION AND COMPACTION EQUIPMENT FOR ERECTING PILES, AND EXCAVATION EQUIPMENT PROVIDED WITH SAID BIT

(75) Inventor: Marco Pedrelli, Cesena (IT)

(73) Assignee: Soilmec S.p.A., Cesena (FO) (IT)

( * ) Notice: Subject to any disclaimer, the term of this patent is extended or adjusted under 35 U.S.C. 154(b) by 56 days.

(21) Appl. No.: 11/411,580

(22) Filed: Apr. 25, 2006

(65) Prior Publication Data

US 2006/0260849 A1 Nov. 23, 2006

(30) Foreign Application Priority Data

May 20, 2005 (IT) ..... TO2005A0347

(51) Int. Cl.
*E02D 7/22* (2006.01)

(52) U.S. Cl. ..... 175/241; 405/232; 175/394

(58) Field of Classification Search ..... 175/241, 175/394, 238, 232, 242; 405/232
See application file for complete search history.

(56) References Cited

U.S. PATENT DOCUMENTS 664,741 A * 12/1900 Gibson ..... 175/241
706,396 A * 8/1902 Ehrenfeld ..... 175/241
957,127 A * 5/1910 Vesey ..... 175/241
2,401,250 A * 5/1946 Kandle ..... 175/394
4,458,765 A * 7/1984 Feklin et al. ..... 175/394
5,013,191 A * 5/1991 Kitanaka ..... 175/394
5,722,498 A * 3/1998 Van Impe et al. ..... 175/394
2002/0071726 A1 6/2002 Johnson
2004/0037652 A1 2/2004 Schmidmaier et al.

FOREIGN PATENT DOCUMENTS

EP 0 371 533 6/1990
EP 0 588 143 A1 3/1994
EP 0 747 537 A1 12/1996

* cited by examiner

*Primary Examiner*—John Kreck
(74) *Attorney, Agent, or Firm*—Merchant & Gould P.C.

(57) ABSTRACT

Described herein is a bit (9) for excavation and compaction equipment (1) for erecting piles, the bit (9) being provided with a central body (21), an excavation screw (24) fixed to the central body (21), and a dislocating element (40) for compaction of the walls of the excavation, a retention device (25) that can be selectively re-closed being associated to the central body (21) for preventing fall of debris beyond a leading edge (27) of the screw (24) during extraction of the bit (9), and the dislocating element (40) being mounted on a fixed portion (28) of the retention device (25), and presenting a radial development, which decreases with respect to a rotation of excavation of the excavation screw (24) for compaction of the walls (3*a*) of the excavation (3) during extraction of the bit (9).

10 Claims, 3 Drawing Sheets

BIT FOR EXCAVATION AND COMPACTION EQUIPMENT FOR ERECTING PILES, AND EXCAVATION EQUIPMENT PROVIDED WITH SAID BIT

BACKGROUND OF THE INVENTION

The present invention relates to a bit for excavation and compaction equipment for erecting piles and to excavation equipment provided with said bit.

From the European patent No. EP 0 228 138 excavation and compaction equipment is known for erecting piles comprising a mast, a rotary table slidably mounted along the mast, a drill rod actuated by the rotary table, and a drill bit, which is mounted at a bottom end of the drill rod itself, and comprises, in turn, a central body having an outer diameter equal to an outer diameter of the rod, an excavation screw fixed to the central body, and a dislocating element arranged along the rod immediately above the screw for compaction of the walls of the excavation during drilling.

In the equipment of the type described above, the dislocating element comprises two closed screws with opposed geometry, which develop from one another around the central body in opposite winding directions, and have an initial outer profile equal to an outer diameter of the screw and an outer final profile tangential to the central body itself in such a way as to compact the soil during excavation.

As has been described also in the same patent referred to above, the equipment is subjected to a twisting moment on the drill rod and to a thrust on the excavation screw that are relatively high in so far as the mass of soil to be compacted during excavation by the dislocating element is considerable and also exerts a high resistance to advance of the bit in the earth itself. A stress of this sort entails construction of equipment of considerable dimensions and, furthermore, also calls for adequate driving power of the motors, which, however, is exploited only in the drilling stage, but not during extraction of the bit from the excavation and during filling thereof by injection of cement/concrete through the bit itself.

SUMMARY OF THE INVENTION

A purpose of the present invention is to provide a bit for excavation and compaction equipment for erecting piles, which will be free from the drawbacks described above, enabling reduction of the stresses on the drill rod.

According to the present invention a bit for excavation and compaction equipment for erecting piles is provided, the bit comprising a central body, a first excavation screw fixed to the central body, and a dislocating element for compaction of the walls of the excavation and being characterized in that it comprises retention means that can be selectively reclosed, set in a position corresponding to a leading edge of the first excavation screw for preventing fall of debris beyond the leading edge itself during extraction of the bit, and in that the dislocating element is mounted on a fixed portion of the retention means, and has a radial development decreasing with respect to a rotation of excavation of the first excavation screw for compaction of the walls of the excavation during extraction of the bit.

In addition, bits of a known type for excavation and compaction equipment are moreover provided with an outlet mouth made in the central body and through which exit of the cement/concrete occurs during the extraction stage, and said mouth is normally closed by means of a metal disk designed to be expelled at the beginning of the step of extraction by the pressure of the cement/concrete itself.

Normally, in order to prevent loss of the metal disk at each cycle of drilling/extraction, said disk is connected to the excavation screw by means of a chain and said connection is not only performed manually by an operator, who may be exposed to the risk of accidental fall of debris, but is also very unstable both if it is made to pass outside of the bit and if it is made to pass inside the bit in so far as, in both conditions, the chain will be in any case subjected to the abrasive action of the excavation screw or of the earth.

A further purpose of the present invention is to provide a bit for excavation and compaction equipment for erecting piles, which will enable a simple and economically advantageous solution to the drawbacks described above regarding the use of the chain and of the metal disk.

According to a preferred embodiment of the present invention, the bit defined above further comprises an outlet mouth for a material for filling of the excavation arranged axially underneath said retention means, and a hatch for closing the outlet mouth.

BRIEF DESCRIPTION OF THE DRAWINGS

The invention will now be described with reference to the annexed plate of drawings, which illustrate a non-limiting example of embodiment thereof, and in which.

DETAILED DESCRIPTION OF THE PREFERRED EMBODIMENT(S)

Figure 1:
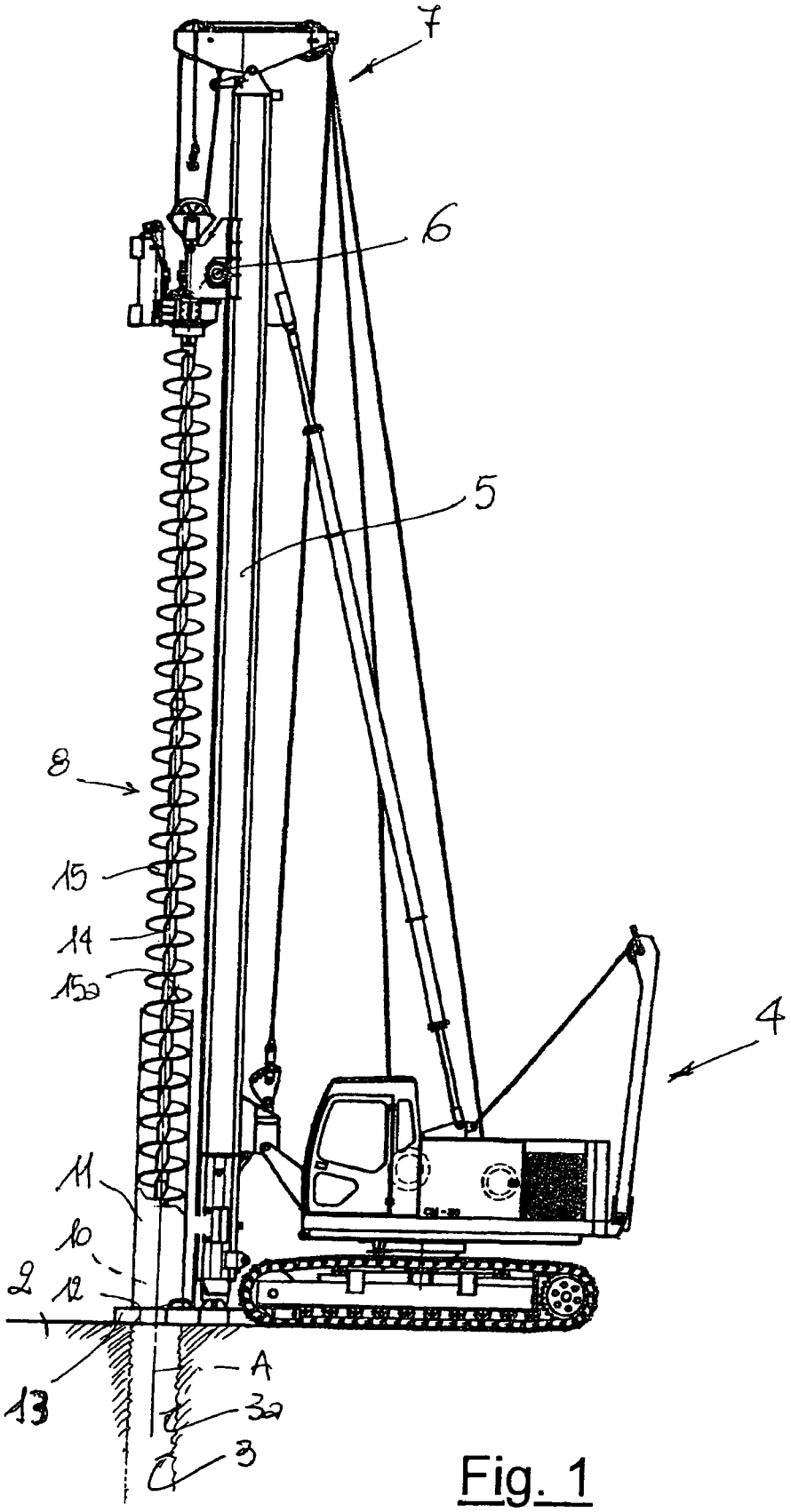
FIG. 1 is a side elevation of a preferred embodiment of the equipment of the present invention.

With reference to FIG. 1, the reference number 1 designates as a whole excavation and compaction equipment for erecting piles in the earth 2 during digging of an excavation 3.

The equipment 1 comprises a tractor or machine 4 for moving purposes, a guide mast 5 mounted on the machine 4, and a rotary table 6, which is coupled to the guide mast 5 for sliding along a longitudinal axis A of the guide mast 5 itself, and is actuated by a rope-and-winch device 7.

The equipment 1 further comprises a helical drill rod 8 actuated by the rotary table 6 so as to turn about the axis A and translate along the axis A itself, and an excavation bit 9 (FIG. 2) mounted at a bottom end 10 of the rod 8 itself for making the excavation 3.

Finally, the equipment 1 comprises a casing 11 arranged around the rod 8 starting from a mouth 12 of the excavation 3, and a platform 13, which rests on the ground 2 around the mouth 12 and is designed both to stabilize better the equipment 1 itself and to prevent tearing of a crater of earth during extraction of the rod 8.

The helical drill rod 8 comprises a hollow central body 14 having a cylindrical shape, and a screw 15, which is fixed to the body 14 and extends throughout the drill rod 8 for collecting the earth that has been broken up during the drilling operation. In particular, the rod 8 is formed by a battery of elements similar to one another, the assemblage of which determines the overall length of the rod 8 itself, as well as the depth of the excavation 3, and collection of the broken-up earth is also enabled by the presence of the casing 11 within which the screw 15 turns and slides freely.

Figure 2:
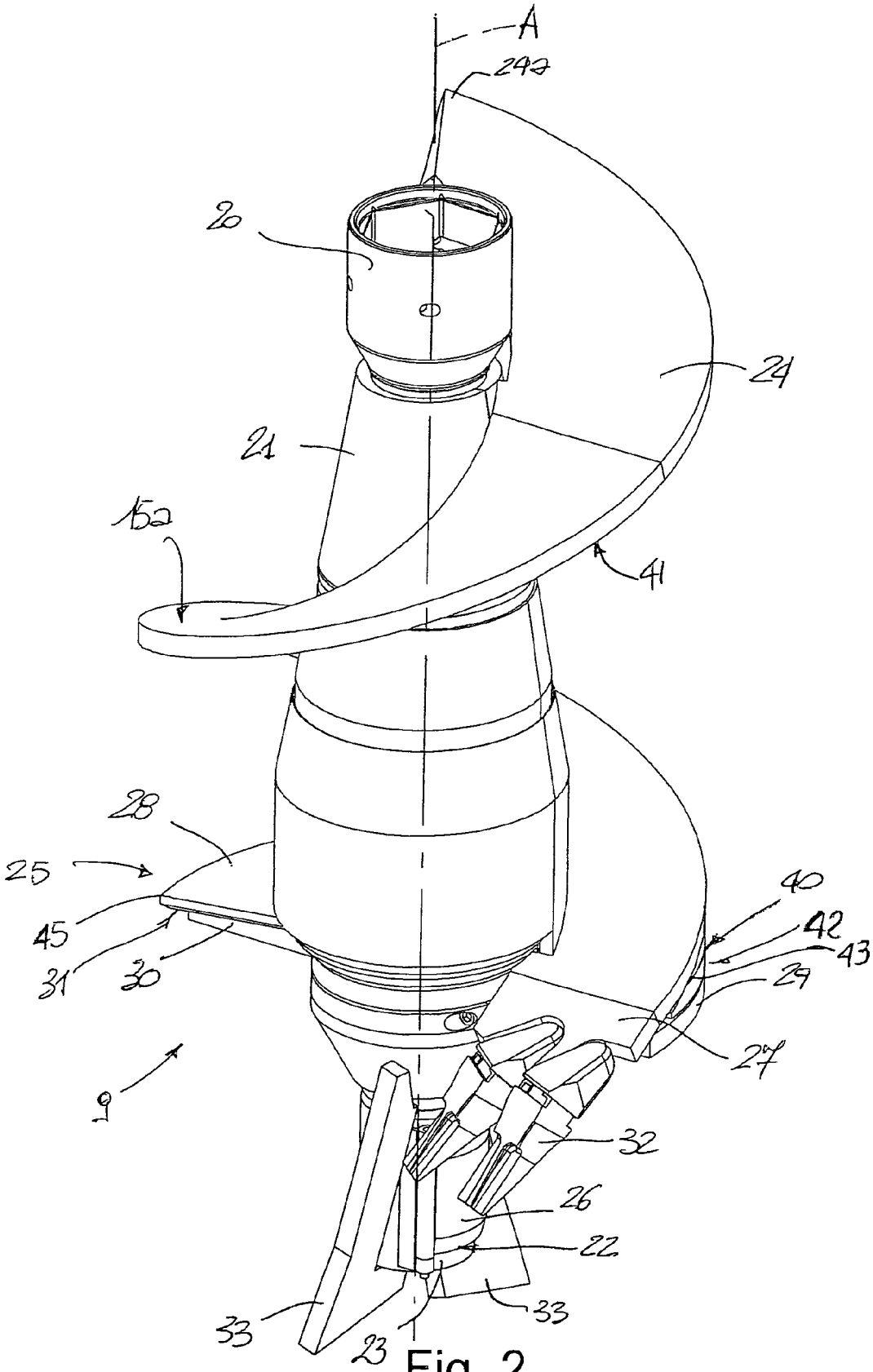
FIGS. 2 and 3 are two views, at an enlarged scale, of an excavation bit of the equipment illustrated in FIG. 1, in two different operating positions.
Figure 3:
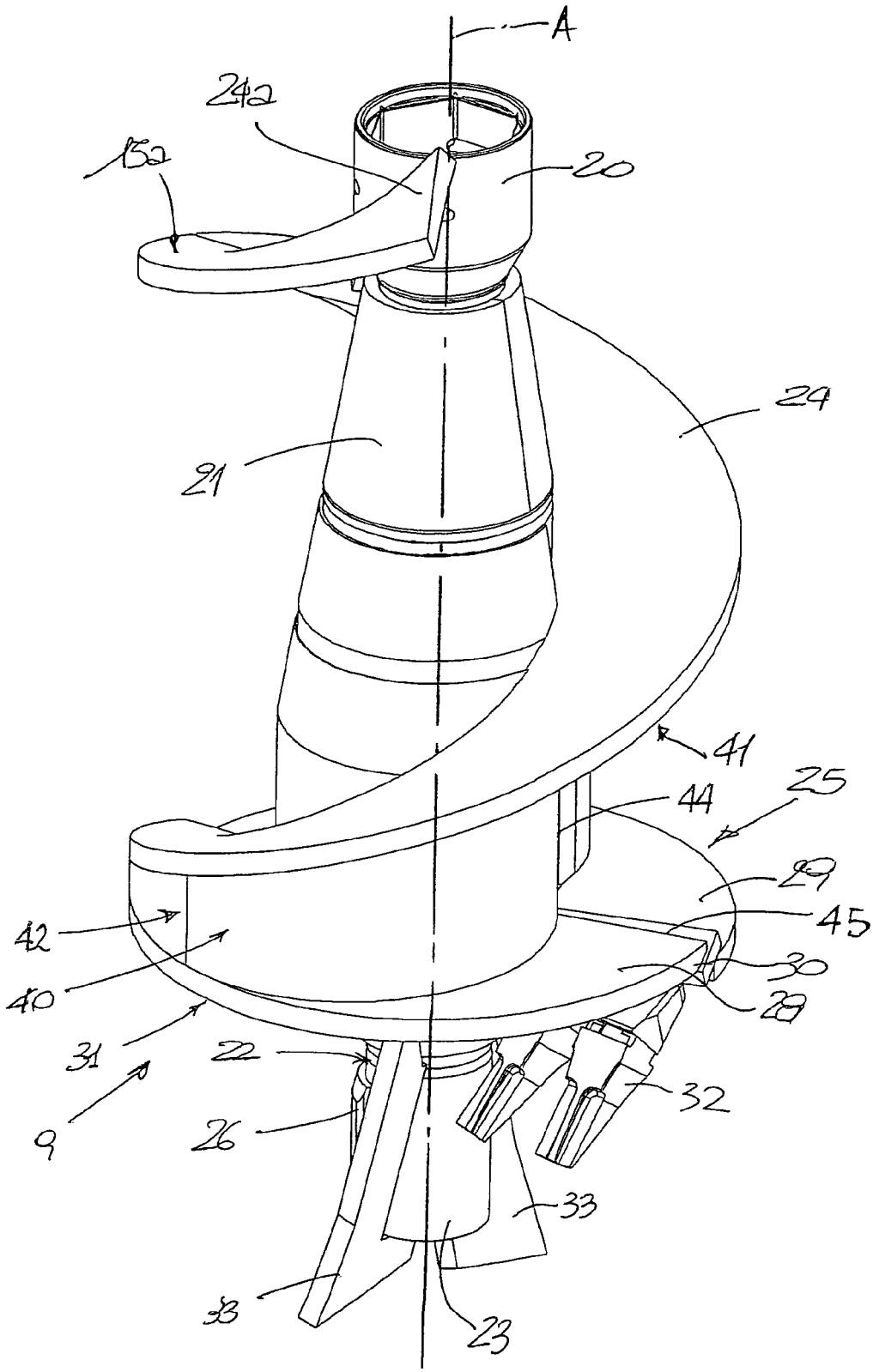

According to what is illustrated in FIGS. 2 and 3, the excavation bit 9 comprises a joint 20 for its own connection to the end 10 of the rod 8, and a central body or stem 21, which has a conical shape tapered towards the joint 20 itself, and is hollow to enable passage of concrete, which is to come out of a mouth 22 arranged in a position corresponding to a bottom end 23 of the stem 21 itself.

The bit 9 further comprises a screw 24 for hoisting of the debris wound around the stem 21 starting from a retention device 25 arranged substantially in a position corresponding to the end 23 above the mouth 22, which is provided with a hatch 26 which has a hemicylindrical shape and is hinged to the stem 21 in such a way as to close the mouth 22 during a rotation of excavation of the bit 9 and in such a way as to free the mouth 22 itself during a rotation of extraction of the bit 9.

In particular, the bit 9 comprises a hinge 22*a*, which is arranged parallel to the axis A and downstream of the mouth 22 with respect to the direction of rotation of extraction of the bit 9, and enables connection of the hatch 26 to the stem 21 as well as free rotation of the hatch 26 itself with respect to the stem 21.

The screw 24 has a respective terminal end 24*a* connected to the screw 15 in such a way as to define a continuous collecting surface 15*a* along the axis A.

The retention device 25 can be selectively activated by rotation of the rod 8 in order to prevent the debris removed by the bit 9 from falling back into the excavation 3, and is arranged in a position corresponding to a leading edge 27 of the screw 24 for preventing fall of debris beyond the leading edge 27 itself during extraction of the drill rod 8 from the excavation 3.

The device 25 comprises a fixed portion 28 fixed to the stem 21 and defined by a semicircular disk 28 transverse to the axis A, and a mobile portion 29, which is coupled to the stem 21 so that it can rotate about the axis A, and is defined by a partition wall 29 shaped like half of a disk. The mobile portion 29 is designed to rotate independently about the axis A according to the direction of rotation of the bit 9, and is mobile between a closing operating position, illustrated in FIG. 3, in which the partition wall 29 and the disk 28 are radially opposed to one another so as to isolate the bottom end 23 of the bit 9 from the screw 15 and enable extraction of the bit 9, and an opening operating position, illustrated in FIG. 2, in which the partition wall 29 and the disk 28 are axially superimposed on one another to enable execution of the excavation operations and collection of the loose earth along the screws 24 and 15, and, hence, on the surface 15*a* of the screw.

The device 25 further comprises a shaped arrest element 30, which is connected to the disk 28 in a position radially opposite to the leading edge 27, and defines an end-of-travel for both rotations of the partition wall 29 about the axis A. In particular, the shaped element 30 extends in a transverse direction from a bottom sliding surface 31 of the disk 28, and defines a fixed contrast for the partition wall 29, which runs substantially in contact to the surface 31 itself.

The device 25 further comprises two teeth 32 for cutting the earth 2, which are fixed to the edge 27, and two drilling teeth 33, which are set in front of and behind the mouth 22 and in a radially lateral position with respect to the bottom end 23 of the stem 21. The teeth 32 can also number more or less than two according to the dimensions of the bit 9, whilst the teeth 33 are set in a transverse direction with respect to the end 23, which has a surface with a cylindrical shape, and has a diameter smaller than that of the stem 21.

Finally, the device 25 comprises a dislocating element 40, which is mounted on the disk 28 axially on the opposite side of the shaped element 30 and simultaneously in contact with a bottom surface 41 of the screw 24, and has a radial development decreasing with respect to the rotation of excavation for compacting the walls 3*a* of the excavation 3 during extraction of the drill rod 8.

The element 40 has an eccentric shape which proceeds inwards in spiral fashion, and is laterally delimited by a surface 42 having a substantially triangular development in plan view with a vertex 43 thereof inserted in the point of conjunction between the screw 24 and the disk 28, and a cathetus 44 thereof inserted in the stem 21 in a position corresponding to a terminal sharp edge 45 of the disk 28 itself. The surface 42 is set tangential to the outside of the disk 28 and of the screw 24 in a position corresponding to the vertex 43, and progressively approaches the spindle 21 until it encounters the spindle 21 itself in a position corresponding to the cathetus 44.

In use, the bit 9 penetrates within the earth 2 by penetrating with a rotation associated to a downward thrust, and generates the excavation 3 having a cylindrical shape by removing progressively the debris that accumulates along the surface 15*a*, partly on the screw 24, and partly on the screw 15.

During penetration of the bit 9, the direction of rotation impressed on the bit 9 itself about the axis A determines both maintenance of the hatch 26 in its closing position and maintenance of the device 25 in its closing position with the partition wall 29 axially superimposed on the disk 28.

At the end of the drilling operation, a direction of rotation is impressed on the bit 9 opposite to the direction of rotation during drilling so causing rotation of the partition wall 29, which consequently sets itself in its own closing operating position. Next, during extraction of the bit 9 once again in counter-rotation, and following upon opening of the hatch 26 also on account of the pressure of the concrete, the excavation 3 itself is filled up with concrete through the mouth 22. The presence of the hatch 26 means that, at the start of each drilling operation, it is not necessary to send an operator to close the mouth 22 with a plug, as currently occurs, exposing the operator himself to the risk of fall of debris.

Closing of the partition wall 29 determines isolation of the end 23 of the bit 9 from the rest of the bit 9 itself and prevents any debris that has accumulated on the surface 15*a* from possibly falling back inside the excavation 3. Consequently, the material removed by drilling that rests on the surface 15*a* is forced to drop down, accumulates between the device 25 and the terminal part of the screw 24, and is compressed against the walls 3*a* by means of the dislocating element 40.

From the above description, it is clear that the bit 9 enables drilling of a wormscrew type, in which the earth is prevalently broken up, accumulated along the screws 24 and 15, and partially conveyed upwards, and with a partial compaction obtained with the stem 21, which basically defines an oversizing of the dimensions of the body 14 of the screw 15. In extension compaction is completed by the dislocating element 40.

In addition, the work of compaction can be carried out in two steps, with a requirement in terms of torque and power spread out over time, and during extraction of the bit 9 there is a total use of power, unlike what occurs with traditional systems, which, instead, do not exploit it.

Once again, the possibility of compacting the earth when the bit 9 is coming back up enables use of a force of pull much greater than the one that can be applied by pushing, given the same weight of the machine 4, hence enabling also use of machines 4 of smaller dimensions, thus contributing to the reducing the costs required for making the excavation 3, and to the ease of transportation of the equipment 1.

Finally, the equipment 1 described above enables steps of penetration to be alternated with steps of compaction at various depths of the excavation 3 so as to minimize the amount of debris removed.

According to one embodiment, which is not illustrated but can be readily inferred from the above description, the equipment 1 can be provided with two rotary tables 6 for independent operation of the rod 8 and of the bit 9 so as to cause independent rotation of the screw 24 and the screw 15. In this case (not illustrated), the rod 8 will be provided with a further internal rod (not illustrated), connected at one end to one of the two rotary tables 6 and, at the opposite end, to the bit 9.

In this way, it will be possible to impress upon the two screws 24 and 15 two speeds of rotation about the axis A that are different from one another in order to obtain a greater control over the amount of earth that descends along the screw 24 with respect to the amount of earth that the dislocating element 40 is able to compact.

It is clear that the invention is not limited to the embodiment described and illustrated herein, which is to be considered merely as an example of embodiment of the bit for excavation and compaction equipment for erecting piles and of the excavation and compaction equipment for erecting piles, which instead may undergo further modifications corresponding to shapes and arrangement of parts and details of construction and assembly.

What is claimed is:

1. A bit for excavation and compaction equipment for erecting piles, the bit comprising:

a central body;

a first excavation screw fixed to the central body;

a dislocating element for compaction of the walls of the excavation;

selectively closable retention means set in a position corresponding to a leading edge of the first excavation screw for preventing the fall of debris beyond the leading edge during extraction of the bit;

wherein the dislocating element is mounted on a fixed portion of the retention means, and has a radial portion decreasing with respect to a rotation of excavation of the first excavation screw for compaction of the walls of the excavation during extraction of the bit.

2. The bit according to claim 1, wherein said retention means comprise a partition wall, which is associated to said fixed portion and is mobile independently about said axis of rotation and during extraction of the drill rod so as to isolate a bottom portion of the bit from said first excavation screw.

3. The bit according to claim 2, wherein said retention means are defined by a disk, which is mounted on the central body in a position substantially tangential to the leading edge and transverse to an axis of rotation of the bit, and comprises a mobile circular sector defining said partition wall, and a fixed circular sector defining said fixed portion.

4. The bit according to claim 3, wherein said retention means comprise at least one tooth for cutting of the earth fixed to a free edge of said partition wall, and a shaped arrest element set between the fixed portion and the partition wall for blocking the partition wall in an open operating position, wherein the partition wall and the fixed portion are axially set on top of one another, and wherein in a closed operating position, the partition wall and the fixed portion are set radially opposite to one another.

5. The bit according to claim 1, further comprising a coupling for engagement to a drill rod of the equipment, wherein the corresponding central body has a shaped element with a diameter increasing starting from the coupling.

6. The bit according to claim 5, wherein the shaped element of the central body has substantially the shape of a truncated cone.

7. Excavation and compaction equipment for erecting piles, comprising a drill rod which is able to rotate about an axis of rotation, the equipment comprising a bit according to claim 1.

8. The equipment according to claim 7, wherein the drill rod comprises a second excavation screw extending throughout the drill rod and configured to collect the earth broken up during drilling, said bit being mounted at a bottom end of the drill rod.

9. The equipment according to claim 7, comprising a casing set around said second excavation screw and on the outside of the excavation for temporary stocking of debris.

10. The equipment according to claim 9, further comprising a containment platform, which is set at an excavation mouth to prevent collapse during extraction of the drill rod, and has a central hole traversed by the drill rod.

* * * * *